US009222706B2

(12) United States Patent
Takayama et al.

(10) Patent No.: US 9,222,706 B2
(45) Date of Patent: Dec. 29, 2015

(54) REFRIGERATION CYCLE APPARATUS AND OPERATING METHOD OF SAME

(75) Inventors: Keisuke Takayama, Tokyo (JP); Yusuke Shimazu, Tokyo (JP); Masayuki Kakuda, Tokyo (JP); Hideaki Nagata, Tokyo (JP); Takeshi Hatomura, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 623 days.

(21) Appl. No.: 13/581,477

(22) PCT Filed: Mar. 25, 2010

(86) PCT No.: PCT/JP2010/002121

§ 371 (c)(1),
(2), (4) Date: Aug. 28, 2012

(87) PCT Pub. No.: WO2011/117924

PCT Pub. Date: Sep. 29, 2011

(65) Prior Publication Data

US 2012/0318001 A1 Dec. 20, 2012

(51) Int. Cl.

| | |
|---|---|
| ***F25B 1/10*** | (2006.01) |
| ***F25B 9/00*** | (2006.01) |
| ***F25B 13/00*** | (2006.01) |
| ***F25B 49/00*** | (2006.01) |
| ***F25B 49/02*** | (2006.01) |

(52) U.S. Cl.

CPC ..... *F25B 1/10* (2013.01); *F25B 49/027* (2013.01); *F25B 2341/0662* (2013.01); *F25B 2400/14* (2013.01); *F25B 2600/0261* (2013.01); *F25B 2600/2513* (2013.01)

(58) Field of Classification Search

CPC ..... F25B 11/02; F25B 1/10; F25B 9/06; F25B 2400/14; F25B 2400/075

USPC ..... 62/286.2, 498, 401, 402, 324.6, 87, 62/513, 510, 196

See application file for complete search history.

(56) References Cited

U.S. PATENT DOCUMENTS 5,987,907 A * 11/1999 Morimoto et al. ..... 62/212
7,849,700 B2 * 12/2010 Seefeldt ..... 62/185

(Continued)

FOREIGN PATENT DOCUMENTS

CN 2886450 Y 4/2007
CN 101506597 A 8/2009

(Continued)

OTHER PUBLICATIONS

Office Action issued on Mar. 13, 2014, by the Chinese Patent Office in corresponding Chinese Patent Application No. 201080065731.4 and an English translation of the Office Action. (6 pages).

(Continued)

*Primary Examiner* — M. Alexandra Elve
*Assistant Examiner* — Henry Crenshaw
(74) *Attorney, Agent, or Firm* — Buchanan Ingersoll & Rooney PC

(57) ABSTRACT

A refrigeration cycle apparatus achieves efficient operation by constantly recovering power in a wide operating range. The refrigeration cycle apparatus regulates a pressure of a high pressure side by changing either one or both of an opening degree of the intermediate-pressure bypass valve and an opening degree of the pre-expansion valve on the basis of a density ratio that is obtained from an inflow refrigerant density of the expander and an inflow refrigerant density of the sub-compressor in an actual operating state and a design volume ratio that has been expected at the time of design and that is obtained from a stroke volume of the sub-compressor, a stroke volume of the expander, and a ratio of a flow rate of the refrigerant flowing to the sub-compressor.

11 Claims, 7 Drawing Sheets

(56) References Cited

U.S. PATENT DOCUMENTS

| | | | | |
|---|---|---|---|---|
| 8,075,283 | B2 * | 12/2011 | Shaw | 417/228 |
| 2004/0074254 | A1 * | 4/2004 | Hiwata et al. | 62/402 |
| 2004/0083751 | A1 | 5/2004 | Nakatani et al. | |
| 2004/0250556 | A1 * | 12/2004 | Sienel | 62/88 |
| 2005/0044876 | A1 * | 3/2005 | Hall et al. | 62/401 |
| 2005/0235689 | A1 * | 10/2005 | Lifson et al. | 62/513 |
| 2006/0086110 | A1 * | 4/2006 | Manole | 62/175 |
| 2006/0168996 | A1 * | 8/2006 | Imai et al. | 62/510 |
| 2008/0060365 | A1 | 3/2008 | Sakitani et al. | |
| 2008/0298992 | A1 * | 12/2008 | Kakuda et al. | 418/55.1 |
| 2010/0251757 | A1 | 10/2010 | Hasegawa et al. | |

FOREIGN PATENT DOCUMENTS

| | | | |
|---|---|---|---|
| JP | 58-188557 | U | 12/1983 |
| JP | 2004-108683 | A | 4/2004 |
| JP | 2004-150748 | A | 5/2004 |
| JP | 3708536 | B2 | 10/2005 |
| JP | 2006242491 | A * | 9/2006 |
| JP | 2008-39237 | A | 2/2008 |
| JP | 2009-162438 | A | 7/2009 |
| KR | 10-2007-0046974 | A | 5/2007 |
| WO | WO 2009/047898 | A1 | 4/2009 |
| WO | 2009/142014 | A1 | 11/2009 |

OTHER PUBLICATIONS

Japanese Office Action (Notification of Reasons for Rejection) dated Jun. 4, 2013, issued in corresponding Japanese Patent Application No. JP2012-506667, and English Translation of the Office Action. (5 pgs.).

International Search Report (PCT/ISA/210) issued on Jun. 29, 2010, by the Japanese Patent Office as the International Searching Authority for International Application No. PCT/JP2010/002121.

* cited by examiner

REFRIGERATION CYCLE APPARATUS AND OPERATING METHOD OF SAME

TECHNICAL FIELD

The present invention relates to refrigeration cycle apparatuses and operating methods of the same, and more particularly relates to a refrigeration cycle apparatus and an operating method of the same that uses a refrigerant that undergoes transition to a supercritical state, that includes coaxially coupled compressor and expander, that recovers expansion power that is generated when the refrigerant is expanded, and that uses the expansion power for compressing the refrigerant.

BACKGROUND ART

In recent years, there has been focus on refrigeration cycle apparatuses that uses, as its refrigerant, carbon dioxide (hereinafter, referred to as $CO_2$), which has zero ozone depleting potential and a markedly small global warming potential as compared with those of chlorofluorocarbons. The critical temperature of the $CO_2$ refrigerant is as low as 31.06 degrees C. When a temperature higher than this temperature is used, the refrigerant at a high-pressure side (from the outlet of a compressor, to a radiator, and then to the inlet of a decompressor) of the refrigeration cycle apparatus enters a supercritical state in which no condensation occurs, thereby decreasing operating efficiency (COP) of the refrigeration cycle apparatus as compared with conventional refrigerants. Hence, means for increasing COP is important to refrigeration cycle apparatuses using a $CO_2$ refrigerant.

As such means, there is suggested a refrigeration cycle that is provided with an expander instead of a decompressor and that recovers pressure energy during expansion as power. Meanwhile, in a refrigeration cycle apparatus with a configuration in which a positive displacement compressor and an expander are coupled with a single shaft, when VC is a stroke volume of the compressor and VE is a stroke volume of the expander, a ratio of the volumetric circulation rate of the refrigerants respectively flowing through the compressor and the expander is determined by VC/VE (a design volume ratio). When DC is density of the refrigerant at an outlet of an evaporator (the refrigerant flowing into the compressor) and DE is density of the refrigerant at an outlet of an radiator (the refrigerant flowing into the expander), a relationship of "VC×DC=VE×DE," that is, a relationship of "VC/VE=DE/DC" is established since the mass circulation rate of the refrigerants respectively flowing through the compressor and the expander are equivalent. VC/VE (the design volume ratio) is a constant that is determined at the time of design of the device. The refrigeration cycle tends to balance itself so that DE/DC (the density ratio) is always constant (hereinafter, this is called "constraint of constant density ratio").

However, use conditions of the refrigeration cycle apparatus are not necessarily constant, and hence if the design volume ratio expected at the time of the design differs to the density ratio in the actual operating state, it would be difficult to regulate the pressure of the high pressure side to an optimal pressure due to the "constraint of constant density ratio."

Owing to this, there is suggested a configuration and a control method for regulating the pressure of the high pressure side to the optimal pressure by providing a bypass that bypasses the expander and controlling the amount of refrigerant flowing into the expander (for example, see Patent Literature 1).

Also, there is suggested a configuration and a control method for regulating the pressure of the high pressure side to the optimal pressure by providing a compression bypass that bypasses a phase from a midway position of a compression process of a main compressor to completion of the compression process, by providing a sub-compressor in the compression bypass, and by controlling the amount of refrigerant flowing into the sub-compressor (for example, see Patent Literature 2).

CITATION LIST

Patent Literature

Patent Literature 1: Japanese Patent No. 3708536 (Claim 1, FIG. 1, etc.)

Patent Literature 2: Japanese Unexamined Patent Application Publication No. 2009-162438 (Claim 1, FIG. 1, etc.)

SUMMARY OF INVENTION

Technical Problem

Patent Literature 1 describes the configuration and the control method that can regulate the pressure of the high pressure side to the optimal pressure by distributing the refrigerant to the bypass that bypasses the expander if the density ratio in the actual operating state is smaller than the design volume ratio; however, the refrigerant flowing through a bypass valve may be subjected to isenthalpic change because of expansion loss. Hence, there is a problem in which an effect of increasing refrigerating effect obtained by the isentropic change while the expander recovers the expansion energy decreases.

In addition, if the amount of refrigerant that bypasses the expander is large, the rotation speed of the expander becomes low and a lubrication state of a sliding portion is degraded. If the rotation speed of the expander becomes excessively low, problems arise such as stagnation of oil in a passage of the expander that causes degradation of reliability such as exhaustion of the oil in the compressor and starting up with the stagnated refrigerant at the time of restart.

Further, Patent Literature 2 attempts to address the above-described problems by not bypassing the expander. However, since the bypass valve is provided at the inlet of the sub-compressor, the pressure at the inlet of the sub-compressor decreases due to pressure loss, and compression power increases by that amount. There is a problem in that the increasing effect of the operating efficiency is decreased.

The present invention is made to address the above problems, and an object of the invention is to provide a refrigeration cycle apparatus and an operating method capable of providing highly efficient operation by constantly recovering power in a wide operating range even if it is difficult to regulate the pressure of the high pressure side to the optimal pressure due to the constraint of constant density ratio.

Solution to Problem

A refrigeration cycle apparatus according to the invention includes a main compressor compressing a refrigerant; a radiator radiating heat of the refrigerant compressed by the main compressor; an expander reducing a pressure of the refrigerant that has passed through the radiator; an evaporator evaporating the refrigerant which has been depressurized by the expander; a sub-compressor having a discharge side connected to a midway position of a compression process of the main compressor, the sub-compressor using power, which is generated in the expander when reducing the pressure of the refrigerant, to compress a portion of the refrigerant passing through the evaporator to an intermediate pressure; an intermediate-pressure bypass connecting a refrigerant outflow side of the sub-compressor and a refrigerant inflow side of the main compressor to each other; an intermediate-pressure bypass valve being provided in the intermediate-pressure bypass, the intermediate-pressure bypass valve controlling a flow rate of the refrigerant flowing through the intermediate-pressure bypass; a pre-expansion valve being provided between a refrigerant outflow side of the radiator and a refrigerant inflow side of the expander, the pre-expansion valve reducing the pressure of the refrigerant flowing into the expander; and a controller controlling an operation of the intermediate-pressure bypass valve and an operation of the pre-expansion valve. The controller regulates a pressure of a high pressure side by changing either one or both of an opening degree of the intermediate-pressure bypass valve and an opening degree of the pre-expansion valve on the basis of a density ratio that is obtained from an inflow refrigerant density of the expander and an inflow refrigerant density of the sub-compressor in an actual operating state and a design volume ratio that has been expected at the time of design and that is obtained from a stroke volume of the sub-compressor, a stroke volume of the expander, and a ratio of a flow rate of the refrigerant flowing to the sub-compressor.

An operating method of a refrigeration cycle apparatus according to the invention includes the steps of: compressing a refrigerant with a main compressor; radiating heat of the refrigerant compressed by the main compressor with a radiator; reducing a pressure of the refrigerant that has passed through the radiator with an expander; evaporating the refrigerant which has been depressurized by the expander with an evaporator; using power, which has been generated in the expander when reducing the pressure of the refrigerant, for compressing a portion of the refrigerant passing through the evaporator to an intermediate pressure with a sub-compressor; injecting the refrigerant compressed to the intermediate pressure by the sub-compressor to a midway position of a compression process of the main compressor; connecting a refrigerant outflow side of the sub-compressor and a refrigerant inflow side of the main compressor to each other with an intermediate-pressure bypass; controlling a flow rate of the refrigerant flowing through the intermediate-pressure bypass with an intermediate-pressure bypass valve; reducing the pressure of the refrigerant that is flowing between a refrigerant outflow side of the radiator and a refrigerant inflow side of the expander and that is flowing into the expander with a pre-expansion valve; and regulating a pressure of a high pressure side by changing either one or both of an opening degree of the intermediate-pressure bypass valve and an opening degree of the pre-expansion valve on the basis of a density ratio that is obtained from an inflow refrigerant density of the expander and an inflow refrigerant density of the sub-compressor in an actual operating state and a design volume ratio that has been expected at the time of design and that is obtained from a stroke volume of the sub-compressor, a stroke volume of the expander, and a ratio of a flow rate of the refrigerant flowing to the sub-compressor.

Advantageous Effects of Invention

With the refrigeration cycle apparatus and the operating method of the refrigeration cycle according to the invention, highly efficient operation can be achieved by recovering the power in the wide operating range and regulating the pressure of the high pressure side through the control of the intermediate-pressure bypass valve and the pre-expansion valve even if it is difficult to regulate the pressure of the high pressure side to the optimal pressure due to the constraint of constant density ratio.

DESCRIPTION OF EMBODIMENTS

Embodiment of the invention will be described below with reference to the drawings.

Figure 1:
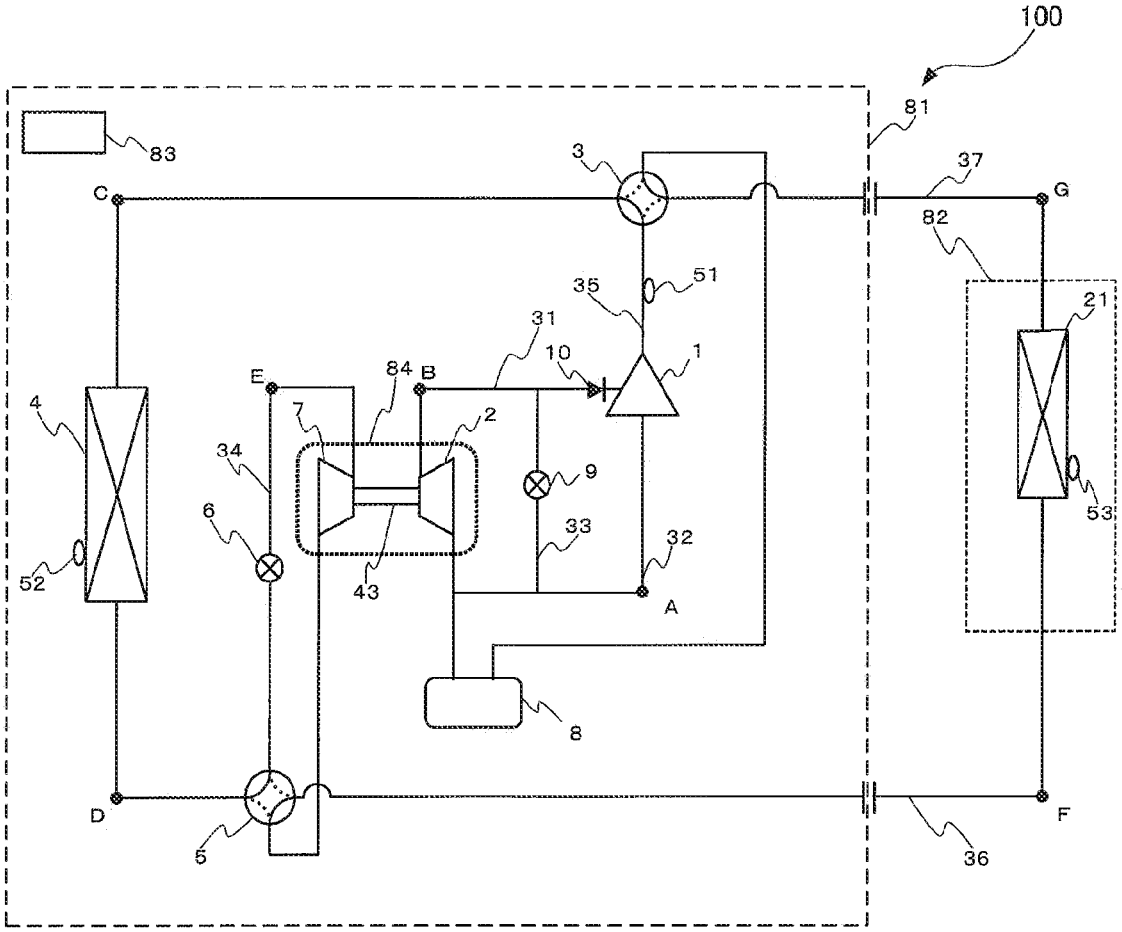
FIG. 1 is a circuit configuration diagram schematically showing a refrigerant circuit configuration of a refrigeration cycle apparatus according to an Embodiment of the invention.
Figure 2:
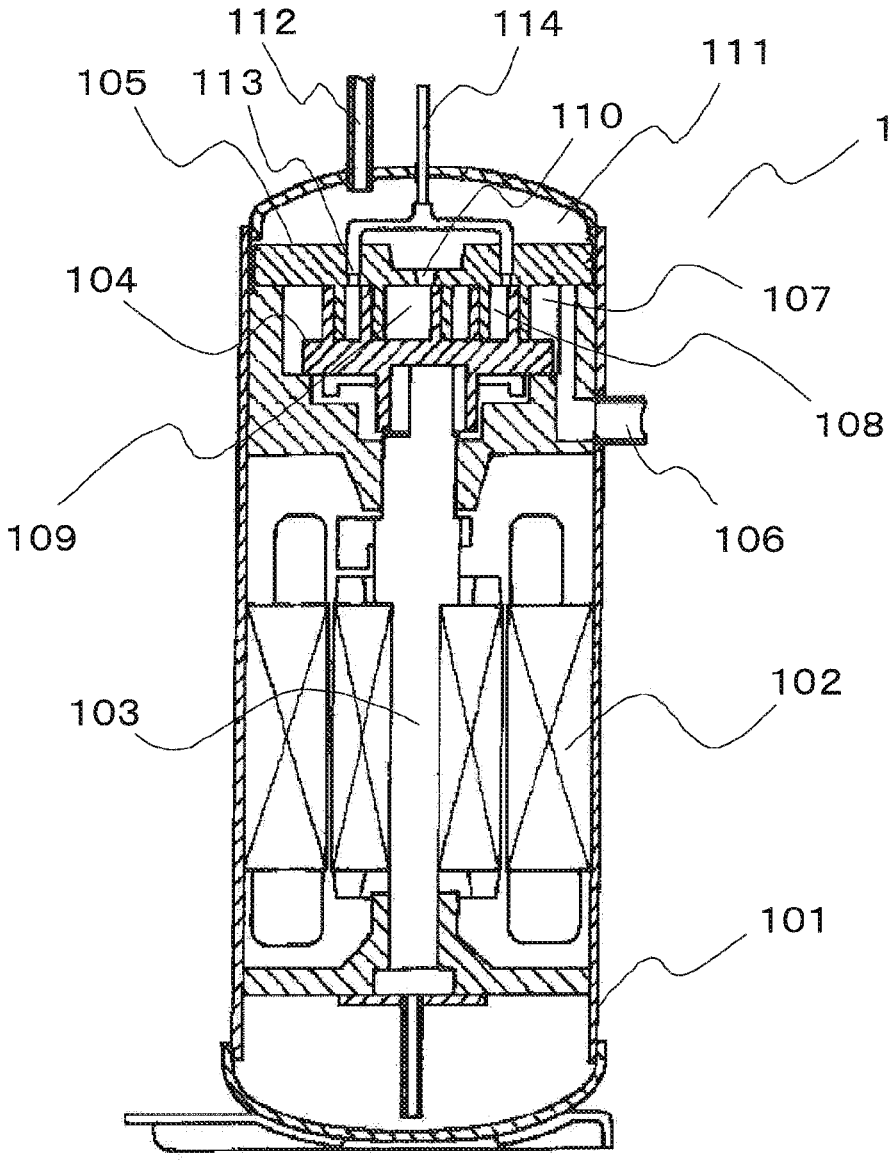
FIG. 2 is a schematic longitudinal section showing a sectional configuration of a main compressor.
Figure 3:
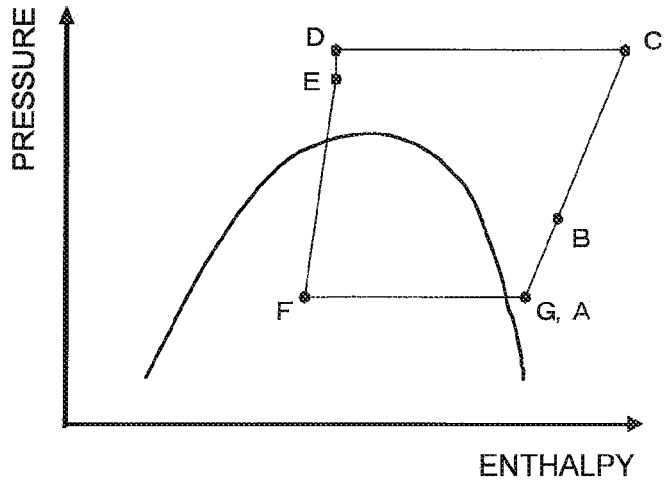
FIG. 3 is a P-h diagram showing transition of a refrigerant during a cooling operation of the refrigeration cycle apparatus according to an Embodiment of the invention.
Figure 4:
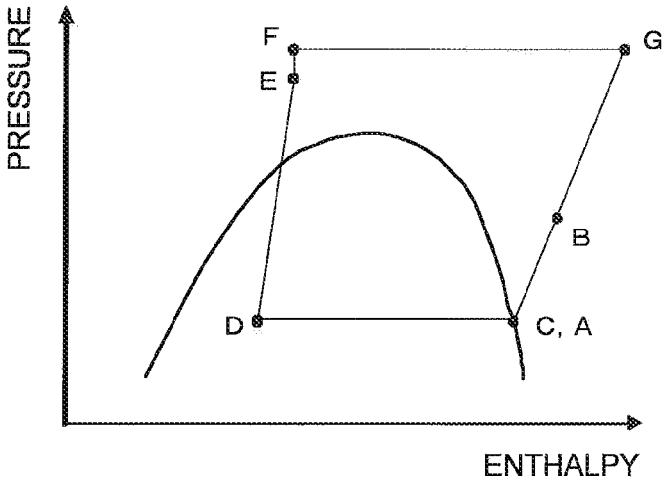
Fig. 4 is a P-h diagram showing transition of the refrigerant during a heating operation of the refrigeration cycle apparatus according to an Embodiment of the invention.
Figure 5:
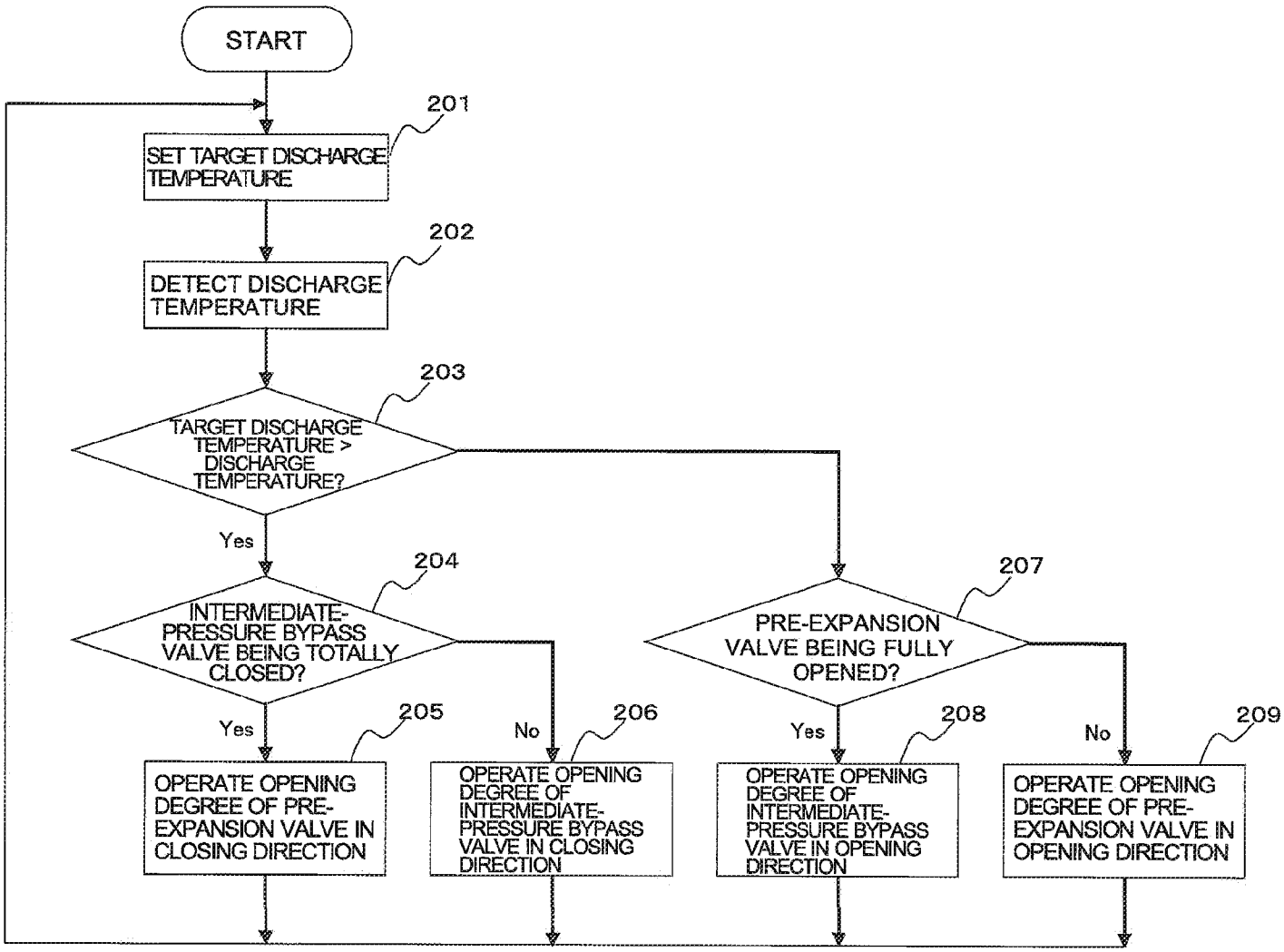
FIG. 5 is a flowchart showing the flow of control processing executed by a controller.
Figure 6:
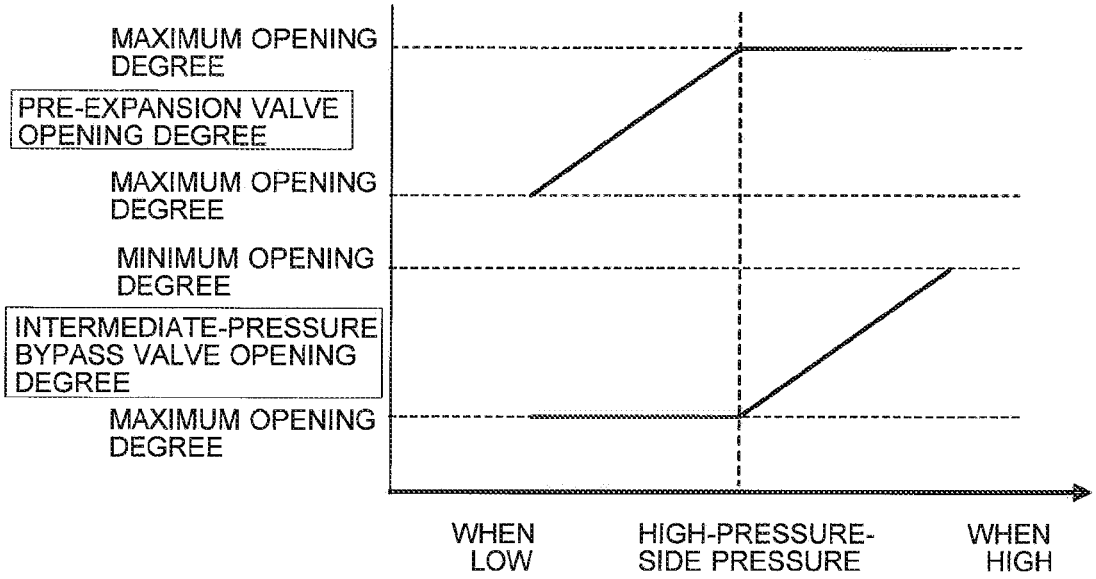
FIG. 6 is an explanatory view showing an operation during cooperative control of an intermediate-pressure bypass valve and a pre-expansion valve.

FIG. 1 is a circuit configuration diagram schematically showing a refrigerant circuit configuration of a refrigeration cycle apparatus 100 according to Embodiment of the invention. FIG. 2 is a schematic longitudinal section showing a sectional configuration of a main compressor 1. FIG. 3 is a P-h diagram showing transition of a refrigerant during a cooling operation of the refrigeration cycle apparatus 100. FIG. 4 is a P-h diagram showing transition of the refrigerant during a heating operation of the refrigeration cycle apparatus 100. FIG. 5 is a flowchart showing the flow of control processing executed by a controller 83. FIG. 6 is an explanatory view showing an operation during cooperative control of an intermediate-pressure bypass valve 9 and a pre-expansion valve 6. A circuit configuration and an operation of the refrigeration cycle apparatus 100 will be described with reference to FIGS. 1 to 6.

The refrigeration cycle apparatus 100 according to Embodiment is used in devices equipped with a refrigeration cycle that circulates a refrigerant and is used, for example, in a refrigerator, a freezer, a vending machine, an air-conditioning apparatus (for domestic use, industrial use, or vehicles, for example), a refrigeration apparatus, or a water heater. It should be noted that the dimensional relationships of components in FIG. 1 and other subsequent drawings may be different from the actual ones. In addition, in FIG. 1 and other subsequent drawings, components applied with the same reference signs correspond to the same or equivalent components. This is common through the full text of the description. Further, forms of components described in the full text of the description are mere examples, and the components are not limited to the described forms of components.

The refrigeration cycle apparatus 100 can constantly recover power in a wide operating range and can perform efficient operations. In particular, the advantageous effect is large when a carbon dioxide refrigerant in which a high-pressure side enters a supercritical state is used.

The refrigeration cycle apparatus 100 at least includes the main compressor 1, an outdoor heat exchanger 4, an expander 7, an indoor heat exchanger 21, and a sub-compressor 2. Also, the refrigeration cycle apparatus 100 includes a first four-way valve 3 serving as a refrigerant passage switching unit, a second four-way valve 5 serving as a refrigerant passage switching unit, the pre-expansion valve 6, an accumulator 8, an intermediate-pressure bypass valve 9, and a check valve 10. Further, the refrigeration cycle apparatus 100 includes a controller 83 that controls the overall control of the refrigeration cycle apparatus 100.

The main compressor 1 compresses a refrigerant, which is sucked by an electric motor 102 and a shaft 103 driven by the electric motor 102, and turns the refrigerant into a high-temperature high-pressure state. This main compressor 1 may be constituted by, for example, a capacity-controllable inverter compressor. It is to be noted that the details of the main compressor 1 is described later with reference to FIG. 2.

The outdoor heat exchanger 4 functions as a radiator in which the refrigerant therein radiates heat during a cooling operation, and functions as an evaporator in which the refrigerant therein evaporates during a heating operation. For example, the outdoor heat exchanger 4 exchanges heat between the air, which is supplied from a fan (not shown), and the refrigerant.

The outdoor heat exchanger 4 has a heat transfer pipe, through which the refrigerant passes, and a fin for increasing a heat transferring area between the refrigerant flowing through the heat transfer pipe and the outdoor air. The outdoor heat exchanger 4 is configured to exchange heat between the refrigerant and the air (the outdoor air). The outdoor heat exchanger 4 functions as an evaporator during the heating operation. The outdoor heat exchanger 4 evaporates and gasifies (vaporizes) the refrigerant. On the other hand, the outdoor heat exchanger 4 functions as a condenser or a gas cooler (hereinafter, referred to as a condenser) during the cooling operation. In some cases, the outdoor heat exchanger 4 may not completely gasify or vaporize the refrigerant, and may turn the refrigerant into a two-phase mixture of gas and liquid (two-phase gas-liquid refrigerant).

The indoor heat exchanger 21 functions as an evaporator in which the refrigerant therein evaporates during the cooling operation, and functions as a radiator in which the refrigerant therein radiates heat during the heating operation. The indoor heat exchanger 21 exchanges heat between the air, which is supplied from a fan (not shown), and the refrigerant.

The indoor heat exchanger 21 has a heat transfer pipe, through which the refrigerant passes, and a fin for increasing a heat transferring area between the refrigerant flowing through the heat transfer pipe and the outdoor air. The indoor heat exchanger 21 is configured to exchange heat between the refrigerant and the indoor air. The indoor heat exchanger 21 functions as an evaporator during the cooling operation. The indoor heat exchanger 21 evaporates the refrigerant and gasifies (vaporizes) the refrigerant. On the other hand, the indoor heat exchanger 21 functions as a condenser or a gas cooler (hereinafter, referred to as condenser) during the heating operation.

The expander 7 reduces the pressure of the refrigerant passing therethrough. Power that is generated when the pressure of the refrigerant is reduced is transferred to the sub-compressor 2 through a driving shaft 43. The sub-compressor 2 is connected to the expander 7 through the driving shaft 43. The sub-compressor 2 is driven by power that is generated when the expander 7 reduces the pressure of the refrigerant, and the sub-compressor 2 compresses the refrigerant. The sub-compressor 2 is connected in parallel to the main compressor 1 in a lower-pressure side.

Regarding the expander 7 and the sub-compressor 2, the driving shaft 43 recovers expansion power that is generated when the expander 7 expands (reduces the pressure of) the refrigerant and the sub-compressor 2 uses the recovered expansion power and compresses the refrigerant. The expander 7 and the sub-compressor 2 are of a positive displacement type, and employ a form of, for example, scroll type. The sub-compressor 2 and the expander 7 are housed in a hermetically sealed container 84. The sub-compressor 2 is connected to the expander 7 through the driving shaft 43, so that the driving shaft 43 recovers the power that is generated in the expander 7 and transfers the power to the sub-compressor 2. Thus, the refrigerant is also compressed in the sub-compressor 2.

The first four-way valve 3 is provided in a discharge piping 35 of the main compressor 1, and has a function of switching the flow direction of the refrigerant in accordance with an operating mode. By switching the first four-way valve 3, connection is made between the outdoor heat exchanger 4 and the main compressor 1, between the indoor heat exchanger 21 and the accumulator 8, between the indoor heat exchanger 21 and the main compressor 1, or between the outdoor heat exchanger 4 and the accumulator 8. That is, the first four-way valve 3 performs switching in accordance with the operating mode relating to cooling and heating based on an instruction of the controller 83, and hence switches the passage of the refrigerant.

The second four-way valve 5 connects the expander 7 to the outdoor heat exchanger 4 or the indoor heat exchanger 21 in accordance with the operating mode. By switching the second four-way valve 5, connection is made between the outdoor heat exchanger 4 and the pre-expansion valve 6, between the indoor heat exchanger 21 and the expander 7, between the indoor heat exchanger 21 and the pre-expansion valve 6, or between the outdoor heat exchanger 4 and the expander 7. That is, the second four-way valve 5 performs switching in accordance with the operating mode relating to cooling and heating based on an instruction of the controller 83, and hence switches the passage of the refrigerant.

During the cooling operation, the first four-way valve 3 is switched such that the refrigerant flows from the main compressor 1 to the outdoor heat exchanger 4 and flows from the indoor heat exchanger 21 to the accumulator 8, and the second four-way valve 5 is switched such that the refrigerant flows from the outdoor heat exchanger 4 to the indoor heat exchanger 21 through the pre-expansion valve 6 and the expander 7. In contrast, during the heating operation, the first four-way valve 3 is switched such that the refrigerant flows from the main compressor 1 to the indoor heat exchanger 21 and flows from the outdoor heat exchanger 4 to the accumulator 8, and the second four-way valve 5 is switched such that the refrigerant flows from the indoor heat exchanger 21 to the outdoor heat exchanger 4 through the pre-expansion valve 6 and the expander 7. With the second four-way valve 5, the direction of the refrigerant passing through the expander 7 is the same in either of the cooling operation and the heating operation.

The pre-expansion valve 6 is provided upstream of the expander 7 and expands the refrigerant by reducing the pressure of the refrigerant, and may be one having a variably controllable opening degree such as an electronic expansion valve. To be more specific, the pre-expansion valve 6 is provided in a refrigerant passage 34 arranged between the second four-way valve 5 and the inlet of the expander 7 (i.e., the refrigerant outflow side of the radiator (the outdoor heat exchanger 4 or the indoor heat exchanger 21) and the refrigerant inflow side of the expander 7), and regulates the pressure of the refrigerant flowing into the expander 7.

The accumulator 8 is provided on the suction side of the main compressor 1 and has a function of retaining the liquid refrigerant so as to prevent the liquid from returning to the main compressor 1 when a failure has occurred in the refrigeration cycle apparatus 100 or during a transient response of the operating state due to a change in operation control. That is, the accumulator 8 has a function of retaining excessive refrigerant in the refrigerant circuit of the refrigeration cycle apparatus 100 and preventing the main compressor 1 from being damaged when the liquid refrigerant returns to the main compressor 1 and the sub-compressor 2 by a large amount.

The intermediate-pressure bypass valve 9 is provided in an intermediate-pressure bypass piping (an intermediate-pressure bypass) 33 that causes the refrigerant to bypass from a discharge piping 31 of the sub-compressor 2 to a suction piping 32 of the main compressor 1, and controls the flow rate of the refrigerant flowing through the intermediate-pressure bypass piping 33. The intermediate-pressure bypass valve 9 may be one having a variably controllable opening degree such as an electronic expansion valve. By adjusting the opening degree of the intermediate-pressure bypass valve 9, the intermediate pressure, which is the discharge pressure of the sub-compressor 2, can be regulated.

The check valve 10 is provided in the discharge piping 31 of the sub-compressor 2, and adjusts the flow direction of the refrigerant flowing into the main compressor 1 to one direction (a direction from the sub-compressor 2 to the main compressor 1). By providing this check valve 10, backflow of the refrigerant occurring when the discharge pressure of the sub-compressor 2 becomes lower than the pressure of a compression chamber 108 of the main compressor 1 can be prevented.

The controller 83 controls the driving frequency of the main compressor 1, the rotation speeds of the fans (not shown) provided near the outdoor heat exchanger 4 and the indoor heat exchanger 21, switching of the first four-way valve 3, switching of the second four-way valve 5, the opening degree of the expander 7, the opening degree of the pre-expansion valve 6, the opening degree of the intermediate-pressure bypass valve 9, and the like.

It is to be noted that description is given in Embodiment assuming that the refrigeration cycle apparatus 100 uses carbon dioxide ($CO_2$) as its refrigerant. Carbon dioxide has characteristics such as zero ozone depleting potential and a small global warming potential as compared with conventional chlorofluorocarbon based refrigerants. However, the refrigerant is not limited to carbon dioxide, and other single refrigerants, mixed refrigerants (for example, a mixed refrigerant of carbon dioxide and diethyl ether), or the like that undergoes transition to a supercritical state may be used as the refrigerant.

In the refrigeration cycle apparatus 100, the main compressor 1, the sub-compressor 2, the first four-way valve 3, the second four-way valve 5, the outdoor heat exchanger 4, the pre-expansion valve 6, the expander 7, the accumulator 8, the intermediate-pressure bypass valve 9, and the check valve 10 are housed in an outdoor unit 81. In addition, in the refrigeration cycle apparatus 100, the controller 83 is also housed in the outdoor unit 81. Further, in the refrigeration cycle apparatus 100, the indoor heat exchanger 21 is housed in an indoor unit 82. FIG. 1 exemplarily illustrates a state in which the single outdoor unit 81 (the outdoor heat exchanger 4) is connected to the single indoor unit 82 (the indoor heat exchanger 21) through a liquid pipe 36 and a gas pipe 37; however, the numbers of connected outdoor units 81 and indoor units 82 are not particularly limited.

In addition, temperature sensors (a temperature sensor 51, a temperature sensor 52, and a temperature sensor 53) are provided in the refrigeration cycle apparatus 100. Temperature information detected by these temperature sensors is sent to the controller 83, and used for control of components of the refrigeration cycle apparatus 100.

The temperature sensor 51 is provided in the discharge piping 35 of the main compressor 1, detects the discharge temperature of the main compressor 1, and may be constituted by, for example, a thermistor. The temperature sensor 52 is provided near the outdoor heat exchanger 4 (for example, on the outer surface), detects the temperature of the air flowing into the outdoor heat exchanger 4, and may be constituted by, for example, a thermistor. The temperature sensor 53 is provided near the indoor heat exchanger 21 (for example, on the outer surface), detects the temperature of the air flowing into the indoor heat exchanger 21, and may be constituted by, for example, a thermistor.

It is to be noted that the installation positions of the temperature sensor 51, the temperature sensor 52, and the temperature sensor 53 are not limited to the positions shown in FIG. 1. For example, the temperature sensor 51 may be installed at any position where the temperature of the refrigerant discharged from the main compressor 1 can be detected, the temperature sensor 52 may be installed at any position where the temperature of the air flowing into the outdoor heat exchanger 4 can be detected, and the temperature sensor 53 may be installed at any position where the temperature of the air flowing into the indoor heat exchanger 21 can be detected.

The configuration and operation of the main compressor 1 will be described with reference to FIG. 2. The main compressor 1 is configured such that a shell 101 which forms the outline of the main compressor 1 houses therein the electric motor 102 serving as a driving source, the shaft 103 serving as the driving shaft rotationally driven by the electric motor 102, an oscillating scroll 104 attached to a distal end of the shaft 103 and rotationally driven together with the shaft 103, a fixed scroll 105 arranged above the oscillating scroll 104 and having a spiral body that meshes with a spiral body of the oscillating scroll 104, and the like. Also, an inflow piping 106 that is connected to the suction piping 32, an outflow piping 112 that is connected to the discharge piping 35, and an injection piping 114 that is connected to the discharge piping 31 are connected to the shell 101.

A low-pressure space 107 that is in communication with the inflow piping 106 is formed in the shell 101, at an outermost periphery portion of the spiral bodies of the oscillating scroll 104 and the fixed scroll 105. A high-pressure space 111 that is in communication with the outflow piping 112 is formed in an upper inner portion of the shell 101. A plurality of compression chambers, whose capacities relatively change, are formed between the spiral body of the oscillating scroll 104 and the spiral body of the fixed scroll (for example, a compression chamber 108 and a compression chamber 109 shown in FIG. 1). The compression chamber 109 illustrates a compression chamber formed at substantially center portions of the oscillating scroll 104 and the fixed scroll 105. The compression chamber 108 illustrates a compression chamber formed during midway of a compression process, at the outside of the compression chamber 109.

An outflow port 110 that allows the compression chamber 109 to be in communication with the high-pressure space 111 is provided at the substantially center portion of the fixed scroll 105. An injection port 113 that allows the compression chamber 108 to be in communication with the injection piping 114 is provided at the midway position of the compression process of the fixed scroll 105. In addition, an Oldham ring (not shown) for stopping rotation movement of the oscillating scroll 104 during eccentric turning movement is arranged in the shell 101. This Oldham ring provides the function of stopping the rotation movement and a function of allowing orbital motion of the oscillating scroll 104.

It is to be noted that the fixed scroll 105 is fixed inside the shell 101. In addition, the oscillating scroll 104 performs orbital motion without performing the rotation movement relative to the fixed scroll 105. Further, the electric motor 102 includes at least a stator that is fixed inside the shell 101, and a rotor that is arranged so as to be rotatable inside an inner peripheral surface of the stator and that is fixed to the shaft 103. The stator has a function of rotatably driving the rotor when the stator is energized. The rotor has a function of being rotatably driven and rotating the shaft 103 when the stator is energized.

The operation of the main compressor 1 will be briefly described. When the electric motor 102 is energized, a torque is generated at the stator and the rotor constituting the electric motor 102, and the shaft 103 is rotated. Since the oscillating scroll 104 is mounted at the distal end of the shaft 103, the oscillating scroll 104 performs the orbital motion. The compression chamber moves toward the center while the capacity of the compression chamber is decreased by the turning movement of the oscillating scroll 104, and hence the refrigerant is compressed.

The refrigerant compressed in the sub-compressor 2 and discharged therefrom passes through the discharge piping 31 and the check valve 10. This refrigerant then flows from the injection piping 114 into the main compressor 1. Meanwhile, the refrigerant passing through the suction piping 32 flows from the inflow piping 106 into the main compressor 1. The refrigerant that has flowed in from the inflow piping 106 flows into the low-pressure space 107, is enclosed in the compression chamber, and is gradually compressed. Then, when the compression chamber reaches the compression chamber 108 at the midway position of the compression process, the refrigerant flows from the injection port 113 into the compression chamber 108.

That is, the refrigerant that has flowed in from the injection piping 114 is mixed with the refrigerant that has flowed in from the inflow piping 106 in the compression chamber 108. Then, the mixed refrigerant is gradually compressed and reaches the compression chamber 109. The refrigerant that has reached the compression chamber 109 passes through the outflow port 110 and the high-pressure space 111, is discharged outside the shell 101 through the outflow piping 112, and passes through the discharge piping 35.

The operating action of the refrigeration cycle apparatus 100 will be described.

<Cooling Operation Mode>

The operation executed by the refrigeration cycle apparatus 100 during the cooling operation will be described with reference to FIGS. 1 and 3. It is to be noted that signs A to G shown in FIG. 1 correspond to signs A to G shown in FIG. 3. In addition, in the cooling operation mode, the first four-way valve 3 and the second four-way valve 5 are controlled in a state indicated by "solid lines" in FIG. 1. Here, the highs and lows of the pressure in the refrigerant circuit and the like of the refrigeration cycle apparatus 100 are not determined in relation to a reference pressure, but relative pressures as the result of an increase in pressure by the main compressor 1 or the sub-compressor 2 and a reduction in pressure by the pre-expansion valve 6 or the expander 7 are respectively expressed as a high pressure and a low pressure. In addition, the highs and lows of the temperature are similarly expressed.

During the cooling operation, first, a low-pressure refrigerant is sucked into the main compressor 1 and the sub-compressor 2. The low-pressure refrigerant sucked into the sub-compressor 2 is compressed by the sub-compressor 2 and turns into an intermediate-pressure refrigerant (from a state A to a state B). The intermediate-pressure refrigerant that has been compressed by the sub-compressor 2 is discharged from the sub-compressor 2, and is introduced into the main compressor 1 through the discharge piping 31 and the injection piping 114. The intermediate-pressure refrigerant is mixed with the refrigerant sucked into the main compressor 1, is further compressed by the main compressor 1, and turns into a high-temperature high-pressure refrigerant (from the state B to a state C). The high-temperature high-pressure refrigerant that has been compressed by the main compressor 1 is discharged from the main compressor 1, passes through the first four-way valve 3, and flows into the outdoor heat exchanger 4.

The refrigerant that has flowed into the outdoor heat exchanger 4 radiates heat by exchanging heat with the outdoor air supplied to the outdoor heat exchanger 4, transfers heat to the outdoor air, and turns into a low-temperature high-pressure refrigerant (from the state C to a state D). The low-temperature high-pressure refrigerant flows out from the outdoor heat exchanger 4, passes through the second four-way valve 5, and passes through the pre-expansion valve 6. The pressure of the low-temperature high-pressure refrigerant is reduced when passing through the pre-expansion valve 6 (from the state D to a state E). The refrigerant whose pressure has been reduced by the pre-expansion valve 6 is sucked into the expander 7. The pressure of the refrigerant that has been sucked into the expander 7 is reduced and the refrigerant becomes low in temperature. Hence, the refrigerant turns into a refrigerant with low quality (from the state E to a state F).

At this time, power is generated in the expander 7 as the result of the reduction in pressure of the refrigerant. The power is recovered by the driving shaft 43, is transferred to the sub-compressor 2, and is used for the compression of the refrigerant by the sub-compressor 2. The refrigerant whose pressure has been reduced by the expander 7 is discharged from the expander 7, passes through the second four-way valve 5, and then flows out from the outdoor unit 81. The refrigerant flowing out from the outdoor unit 81 flows through the liquid pipe 36 and flows into the indoor unit 82.

The refrigerant that has flowed into the indoor unit 82 flows into the indoor heat exchanger 21, receives heat from the indoor air supplied to the indoor heat exchanger 21 and evaporates, and turns into a refrigerant still low in pressure but with high quality (from the state F to a state G). Accordingly, the indoor air is cooled. This refrigerant flows out from the indoor heat exchanger 21, also flows out from the indoor unit 82, flows through the gas pipe 37, and flows into the outdoor unit 81. The refrigerant that has flowed into the outdoor unit 81 passes through the first four-way valve 3, flows into the accumulator 8, and is sucked into the main compressor 1 and the sub-compressor 2 again.

The refrigeration cycle apparatus 100 repeats the above-described operation and, accordingly, the heat of the indoor air is transferred to the outdoor air; hence, the indoor air is cooled.

<Heating Operation Mode>

The operation executed by the refrigeration cycle apparatus 100 during the heating operation will be described with reference to FIGS. 1 and 4. It is to be noted that signs A to G shown in FIG. 1 correspond to signs A to G shown in FIG. 4. In addition, in the heating operation mode, the first four-way valve 3 and the second four-way valve 5 are controlled in a state indicated by "broken lines" in FIG. 1. Here, the highs and lows of the pressure in the refrigerant circuit and the like of the refrigeration cycle apparatus 100 are not determined in relation to a reference pressure, but relative pressures as the result of an increase in pressure by the main compressor 1 or the sub-compressor 2 and a reduction in pressure by the pre-expansion valve 6 or the expander 7 are respectively expressed as a high pressure and a low pressure. In addition, the highs and lows of the temperature are similarly expressed.

During the heating operation, first, a low-pressure refrigerant is sucked into the main compressor 1 and the sub-compressor 2. The low-pressure refrigerant sucked into the sub-compressor 2 is compressed by the sub-compressor 2 and turns into an intermediate-pressure refrigerant (from a state A to a state B). The intermediate-pressure refrigerant that has been compressed by the sub-compressor 2 is discharged from the sub-compressor 2, and is introduced into the main compressor 1 through the discharge piping 31 and the injection piping 114. The intermediate-pressure refrigerant is mixed with the refrigerant sucked into the main compressor 1, is further compressed by the main compressor 1, and turns into a high-temperature high-pressure refrigerant (from the state B to a state G). The high-temperature high-pressure refrigerant that has been compressed by the main compressor 1 is discharged from the main compressor 1, passes through the first four-way valve 3, and flows out from the outdoor unit 81.

The refrigerant that has flowed out from the outdoor unit 81 flows through the gas pipe 37 and flows into the indoor unit 82. The refrigerant that has flowed into the indoor unit 82 flows into the indoor heat exchanger 21, radiates heat by exchanging heat with the indoor air supplied to the indoor heat exchanger 21, transfers heat to the indoor air, and turns into a low-temperature high-pressure refrigerant (from the state G to the state F). Accordingly, the indoor air is heated. This low-temperature high-pressure refrigerant flows out from the indoor heat exchanger 21, flows out from the indoor unit 82, flows through the liquid pipe 36, and flows into the outdoor unit 81. The refrigerant that has flowed into the outdoor unit 81 passes through the second four-way valve 5, and passes through the pre-expansion valve 6. The pressure of the low-temperature high-pressure refrigerant is reduced when passing through the pre-expansion valve 6 (from the state F to a state E).

The refrigerant whose pressure has been reduced by the pre-expansion valve 6 is sucked into the expander 7. The pressure of the refrigerant that has been sucked into the expander 7 is reduced and the refrigerant becomes low in temperature. Hence, the refrigerant turns into a refrigerant with low quality (from the state E to a state D). At this time, power is generated in the expander 7 as the result of the reduction in pressure of the refrigerant. The power is recovered by the driving shaft 43, is transferred to the sub-compressor 2, and is used for the compression of the refrigerant by the sub-compressor 2. The refrigerant whose pressure has been reduced by the expander 7 is discharged from the expander 7, passes through the second four-way valve 5, and then flows into the outdoor heat exchanger 4. The refrigerant that has flowed into the outdoor heat exchanger 4 receives heat from the outdoor air supplied to the outdoor heat exchanger 4 and evaporates, and turns into a refrigerant still low in pressure but with high quality (from the state D to a state C).

The refrigerant flows out from the outdoor heat exchanger 4, passes through the first four-way valve 3, flows into the accumulator 8, and is sucked into the main compressor 1 and the sub-compressor 2 again.

The refrigeration cycle apparatus 100 repeats the above-described operation and, accordingly, the heat of the outdoor air is transferred to the indoor air; hence, the indoor air is heated.

Here, the flow rates of the refrigerant of the sub-compressor 2 and the expander 7 will be described.

It is assumed that GE is a flow rate of the refrigerant flowing through the expander 7, and GC is a flow rate of the refrigerant flowing through the sub-compressor 2. Also, when it is assumed that W is a ratio of the flow rate (referred to as diversion ratio) of the refrigerant flowing to the sub-compressor 2 among the total flow rate of the refrigerant flowing to the main compressor 1 and the sub-compressor 2, the relationship between GE and GC is expressed by Expression (1) as follows.

$$GC=W\times GE \qquad \text{Expression (1)}$$

Hence, when VC is a stroke volume of the sub-compressor 2, VE is a stroke volume of the expander 7, DC is an inflow refrigerant density of the sub-compressor 2, and DE is an inflow refrigerant density of the expander 7, the constraint of constant density ratio is expressed by Expression (2) as follows.

$$VC/VE/W=DE/DC \qquad \text{Expression (2)}$$

In addition, the diversion ratio W may be determined such that the recovery power of the expander 7 and the compression power of the sub-compressor 2 are substantially equivalent to each other. To be more specific, when hE is a specific enthalpy of the inlet of the expander 7, hF is a specific enthalpy of the outlet of the expander 7, hA is a specific enthalpy of the inlet of the sub-compressor 2, and hB is a specific enthalpy of the outlet of the sub-compressor 2, the diversion ratio W may be determined to satisfy Expression (3) as follows.

$$hE-hF=W\times(hB-hA) \qquad \text{Expression (3)}$$

Since the refrigeration cycle apparatus 100 injects the refrigerant to the main compressor 1 after the sub-compressor 2 compresses part of the low-pressure refrigerant to the intermediate pressure, an electric input of the main compressor 1 can be reduced by the amount of the compression power of the sub-compressor 2.

Next, the cooling operation when a density ratio (DE/DC) in an actual operating state differs to a design volume ratio (VC/VE/W) expected at the time of design will be described.

<Cooling Operation when (DE/DC)>(VC/VE/W)>

A cooling operation when the density ratio (DE/DC) in the actual operating state is larger than the design volume ratio (VC/VE/W) expected at the time of the design will be described. In this case, due to the constraint of constant density ratio, the refrigeration cycle tends to balance itself so that the inlet refrigerant density (DE) decreases while the pressure of the high pressure side is kept in a low pressure state.

However, when in the state in which the pressure of the high pressure side is lower than a desirable pressure, operating efficiency decreases.

Owing to this, if the intermediate-pressure bypass valve 9 is not in a totally closed state, the intermediate-pressure bypass valve 9 is operated in the closing direction, so as to increase the intermediate pressure and increase the required compression power of the sub-compressor 2. Then, the expander 7 will tend to decrease its rotation speed; hence, the refrigeration cycle will tend to balance itself towards increasing the inlet density of the expander 7.

Figure 7:
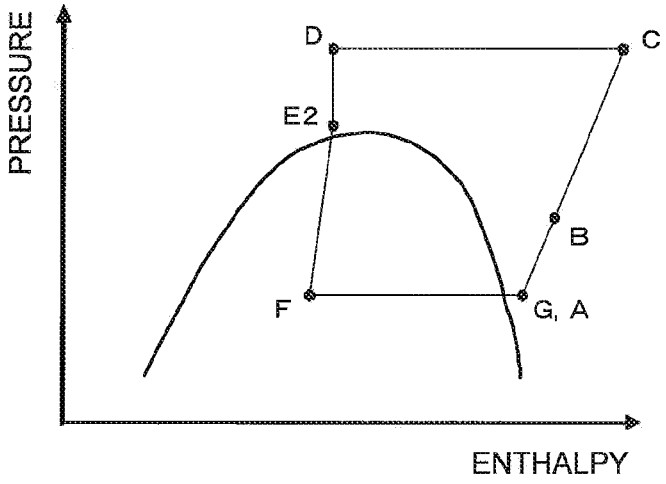
FIG. 7 is a P-h diagram showing transition of the refrigerant when an operation of closing the pre-expansion valve 6 is performed during the cooling operation executed by the refrigeration cycle apparatus according to an Embodiment of the invention.

Alternatively, if the intermediate-pressure bypass valve 9 is in a totally closed state, the pre-expansion valve 6 is operated in the closing direction, so as to expand the refrigerant flowing into the expander 7 (from the state D to a state E2) as shown in FIG. 7 and decrease the refrigerant density. Then, the refrigeration cycle will tend to balance itself towards increasing the inlet density of the expander 7. FIG. 7 is a P-h diagram showing transition of the refrigerant when an operation of closing the pre-expansion valve 6 is performed during the cooling operation executed by the refrigeration cycle device 100.

To be more specific, in the cooling operation when (DE/DC)>(VC/VE/W), the refrigeration cycle apparatus 100 controls the intermediate-pressure bypass valve 9 to be closed or the pre-expansion valve 6 to be closed so that the refrigeration cycle is balanced towards increasing the pressure of the high pressure side. Owing to this, the refrigeration cycle apparatus 100 can increase the pressure of the high pressure side and regulate the pressure of the high pressure side to the desirable pressure. In addition, since no refrigerant bypasses the expander 7, efficient operation can be achieved. It is to be noted that the pressure of the high pressure side refers to a pressure from the outflow port of the main compressor 1 to the pre-expansion valve 6, and may be a pressure at any position between the outflow port of the main compressor 1 and the pre-expansion valve 6.

<Cooling Operation when (DE/DC)<(VC/VE/W)>

A cooling operation when the density ratio (DE/EC) in the actual operating state is smaller than the design volume ratio (VC/VE/W) expected at the time of the design will be described. In this case, due to the constraint of constant density ratio, the refrigeration cycle tends to balance itself so that the inlet refrigerant density (DE) increases while the pressure of the high pressure side is kept in a high pressure state. However, when in the state in which the pressure of the high pressure side is higher than the desirable pressure, operating efficiency decreases.

Owing to this, if the pre-expansion valve 6 is not in a fully opened state, the pre-expansion valve 6 is operated in the opening direction, so that the refrigerant flowing into the expander 7 does not expand and the refrigerant density is increased. Then, the refrigeration cycle will tend to balance itself towards decreasing the inlet density of the expander 7.

Figure 8:
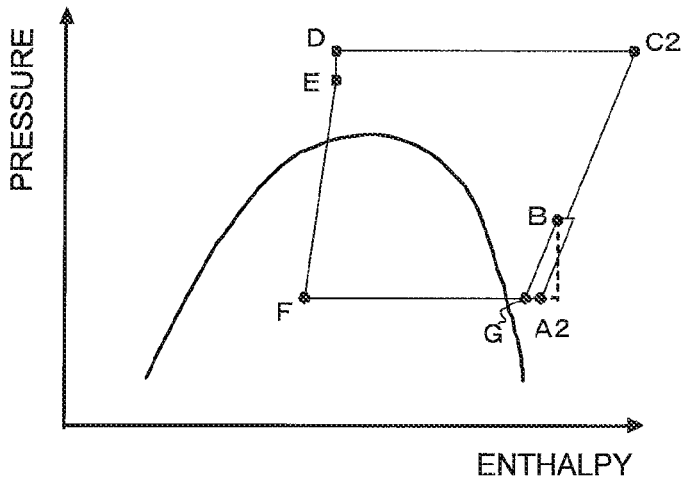
FIG. 8 is a P-h diagram showing transition of the refrigerant when an operation of opening the intermediate-pressure bypass valve is performed during the cooling operation executed by the refrigeration cycle apparatus according to an Embodiment of the invention.

Alternatively, if the pre-expansion valve 6 is in a fully opened state, the intermediate-pressure bypass valve 9 is operated in the opening direction. The operation of the refrigerant cycle at this time will be described with reference to FIG. 8. FIG. 8 is a P-h diagram showing transition of the refrigerant when an operation of opening the intermediate-pressure bypass valve 9 is performed during the cooling operation executed by the refrigeration cycle device 100.

The sub-compressor 2 compresses the refrigerant flowing out from the accumulator 8 to an intermediate pressure (from the state G to the state B). Part of the refrigerant discharged from the sub-compressor 2 passes through the check valve 10 and is injected to the main compressor 1. Also, residual part of the refrigerant discharged from the sub-compressor 2 passes through the intermediate-pressure bypass valve 9, and joins the refrigerant flowing through the suction piping 32 of the main compressor 1 (a state A2). The refrigerant in the state A2 sucked into the main compressor 1 is mixed with the refrigerant compressed to the intermediate pressure and injected, and is further compressed (a state C2). Then, the intermediate-pressure is reduced, the required compression power of the sub-compressor 2 is decreased, and the expander 7 tends to increase its rotation speed; hence the refrigeration cycle tends to balance itself towards decreasing the inlet density of the expander 7.

To be more specific, in the cooling operation when (DE/DC)<(VC/VE/W), the refrigeration cycle apparatus 100 controls the pre-expansion valve 6 to be opened or the intermediate-pressure bypass valve 9 to be opened so that the refrigeration cycle is balanced towards decreasing the pressure of the high pressure side. Owing to this, the refrigeration cycle apparatus 100 can decrease the pressure of the high pressure side and regulate the pressure of the high pressure side to the desirable pressure. In addition, since no refrigerant bypasses the expander 7, efficient operation can be achieved.

<Heating Operation when (DE/DC)≠(VC/VE/W)>

There may be a case in which the density ratio (DE/DC) in the actual operating state of the heating operation differs to the design volume ratio (VC/VE/W) expected at the time of the design. The operations of the sub-compressor 2 and the expander 7 are controlled in a similar manner to that of the cooling operation, and hence the description is omitted.

Next, as a specific operating method of the intermediate-pressure bypass valve 9 and the pre-expansion valve 6, the flow of a control processing executed by the controller 83 will be described with reference to a flowchart shown in FIG. 5.

The refrigeration cycle apparatus 100 uses the correlation between the pressure of the high pressure side and the discharge temperature and executes the control of the intermediate-pressure bypass valve 9 and the pre-expansion valve 6 based on the discharge temperature that is relatively inexpensively measured, without depending on the pressure of the high pressure side that needs an expensive sensor for measurement.

When the refrigeration cycle apparatus 100 is in operation, the optimal pressure of the high pressure side is not always constant. Hence, in the refrigeration cycle apparatus 100, storage means such as a ROM mounted on the controller 83 stores, in advance, data such as the outdoor air temperature detected by the temperature sensor 52 and the indoor temperature detected by the temperature sensor 53, in a form of a table. Further, the controller 83 determines a target discharge temperature from the data stored in the storage means (step 201). Next, the controller 83 fetches a detection value (discharge temperature) from the temperature sensor 51 (step 202). The controller 83 compares the target discharge temperature determined in step 201 and the discharge temperature fetched in step 202 (step 203).

If the discharge temperature is lower than the target discharge temperature (step 203; YES), since the pressure of the high pressure side tends to be lower than the optimal pressure of the high pressure side, the controller 83 determines first whether or not the intermediate-pressure bypass valve 9 is totally closed (step 204). If the intermediate-pressure bypass valve 9 is totally closed (step 204; YES), the controller 83 operates the pre-expansion valve 6 in the closing direction (step 205) to reduce the pressure of the refrigerant flowing into the expander 7, to decrease the refrigerant density, and to increase the pressure of the high pressure side and the discharge temperature. If the intermediate-pressure bypass valve 9 is not totally closed (step 204; NO), the controller 83 operates the intermediate-pressure bypass valve 9 in the closing direction (step 206) to increase the intermediate pressure, to increase the required compression force of the sub-compressor 2, and to increase the pressure of the high pressure side and the discharge temperature.

In contrast, if the discharge temperature is higher than the target discharge temperature (step 203; NO), since the pressure of the high pressure side tends to be higher than the optimal pressure of the high pressure side, the controller 83 determines first whether or not the pre-expansion valve 6 is fully opened (step 207). If the pre-expansion valve 6 is fully opened (step 207; YES), the controller 83 operates the intermediate-pressure bypass valve 9 in the opening direction (step 208) to reduce the intermediate pressure, to decrease the required compression force of the sub-compressor 2, and to reduce the pressure of the high pressure side and the discharge temperature. Also, if the pre-expansion valve 6 is not fully opened (step 207; NO), the controller 83 operates the pre-expansion valve 6 in the opening direction (step 209) so as not to reduce the pressure of the refrigerant flowing into the expander 7, and to reduce the pressure of the high pressure side and the discharge temperature.

After these steps, the control returns to step 201, and repeats step 201 to step 209. Since such control is executed, the cooperative control of the intermediate-pressure bypass valve 9 and the pre-expansion valve 6 can be achieved as shown in FIG. 6. To be more specific, the controller 83 regulates the pressure of the high pressure side by operating the pre-expansion valve 6 when the pressure of the high pressure side is low and the opening degree of the intermediate-pressure bypass valve is at its minimum, and by operating the intermediate-pressure bypass valve 9 when the pressure of the high pressure side is high and the opening degree of the pre-expansion valve 6 is at its maximum. It is to be noted that, in FIG. 6, the horizontal axis indicates the high/low level of the pressure of the high pressure side, the upper section of the vertical axis indicates the opening degree of the pre-expansion valve 6, and the lower section of the vertical axis indicates the opening degree of the intermediate-pressure bypass valve 9.

As described above, the refrigeration cycle apparatus 100 uses the expander 7 that has difficulty in maintaining the pressure of the high pressure side to an optimal pressure due to the constraint of constant density ratio. However, even if the density ratio (DE/DC) in the actual operating state is smaller or larger than the design volume ratio (VC/VE/W) expected at the time of design, the pressure of the high pressure side is regulated to the desirable pressure and power is reliably recovered without having the refrigerant to bypass the expander 7 by way of the opening-degree operation of the intermediate-pressure bypass valve 9 and the pre-expansion valve 6. Owing to this, the refrigeration cycle apparatus 100 is capable of achieving an operation that does not drop the operating efficiency or the operating performance, and can ensure reliability of the expander 7 and the main compressor 1.

Also, in the refrigeration cycle apparatus 100, the target value of the opening-degree operation of the intermediate-pressure bypass valve 9 and the pre-expansion valve 6 is the discharge temperature of the main compressor 1; however, a pressure sensor may be provided in the discharge piping 35 of the main compressor 1 and the target value may be controlled based on the discharge pressure.

In the refrigeration cycle apparatus 100, the target value of the opening-degree operation of the intermediate-pressure bypass valve 9 and the pre-expansion valve 6 is the discharge temperature of the main compressor 1; however, the target value may be a degree of superheat at the refrigerant outlet of the indoor heat exchanger 21 functioning as an evaporator during the cooling operation. In this case, the controller 83 may determine the target degree of superheat on the basis of information from a pressure sensor, which detects a low-pressure-side pressure, arranged in the refrigerant piping between the outlet of the expander 7 and the main compressor 1 or the sub-compressor 2 and information from a temperature sensor that detects a refrigerant outlet temperature of the indoor heat exchanger 21, in which the information is stored, in advance, in a ROM or the like in a form of a table.

In addition, the target degree of superheat may be set by providing a controller in the indoor unit 82. In this case, the target degree of superheat may be sent to the controller 83 through communication between the indoor unit 82 and the outdoor unit 81 in a wired or wireless manner.

Further, regarding the relationship between the pressure of the high pressure side and the degree of superheat of the evaporator, it will be such that higher the pressure of the high pressure side, larger the degree of superheat, and lower the pressure of the high pressure side, smaller the degree of superheat. Thus, control may be executed such that the discharge temperature in step 203 in the flowchart of FIG. 5 is replaced with the degree of superheat.

Also, in the refrigeration cycle apparatus 100, the target value of the opening-degree operation of the intermediate-pressure bypass valve 9 and the pre-expansion valve 6 is the discharge temperature of the main compressor 1; however, the target value may be a degree of supercooling at the refrigerant outlet of the indoor heat exchanger 21 functioning as a condenser during the heating operation.

Figure 9:
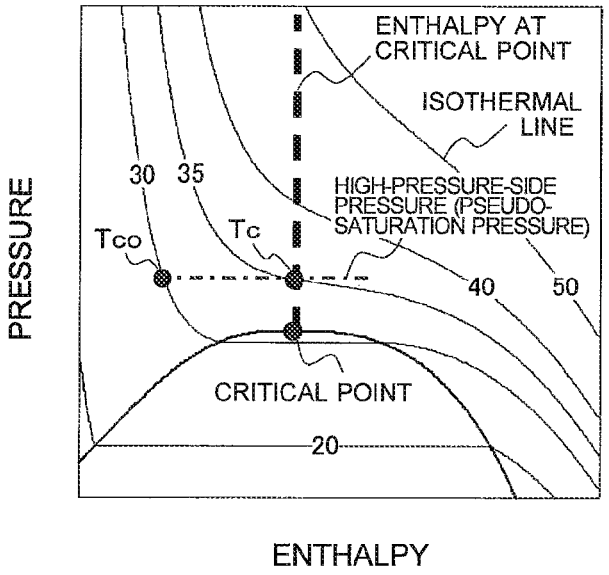
FIG. 9 is a P-h diagram showing a part of transition of a carbon dioxide refrigerant.
Figure 10:
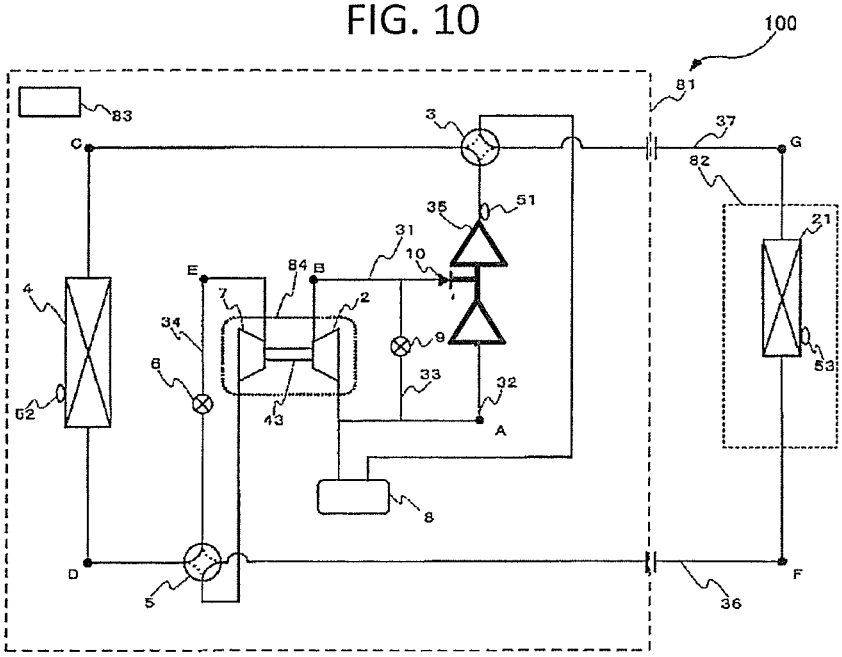
FIG. 10 is a circuit configuration diagram schematically showing a refrigerant circuit configuration of a refrigeration cycle apparatus according to an Embodiment of the invention.

Embodiment exemplarily shows the case in which $CO_2$ is used as the refrigerant of the refrigeration cycle apparatus 100. In a case in which such a refrigerant is used, when the air temperature of the condenser is high, the refrigerant is not condensed at the high-pressure side unlike conventional chlorofluorocarbon based refrigerants and enters a supercritical cycle. Hence, the degree of supercooling cannot be calculated from a saturated pressure and a temperature. Owing to this, as shown in FIG. 9, a pseudo-saturation pressure and a pseudo-saturation temperature Tc may be determined based on an enthalpy at the critical point, and the difference with a refrigerant temperature Tco may be used as a pseudo degree of supercooling Tsc (see the following Expression (4)).

$$Tsc = Tc - Tco \qquad \text{Expression (4)}$$

Further, regarding the relationship between the pressure of the high pressure side and the degree of superheat of the condenser, it will be such that higher the pressure of the high pressure side, larger the degree of supercooling, and lower the pressure of the high pressure side, smaller the degree of supercooling. Thus, control may be executed such that the discharge temperature in step 203 in the flowchart of FIG. 5 is replaced with the degree of supercooling.

With the refrigeration cycle apparatus 100, phenomena causing concern when the amount by which the refrigerant bypasses the expander 7 is large leading to degradation of reliability, such as degradation in the lubrication state in the sliding portion due to low rotation speed of the expander 7, exhaustion of oil in the compressor due to stagnation of oil in the expander and the passage of the expander 7, and starting up with the stagnated refrigerant at the time of restart, can be reduced.

With the refrigeration cycle apparatus 100, since an expander bypass valve is not needed, there will be no expansion loss that is caused when the refrigerant is expanded by the expander bypass valve and a decrease in refrigerating effect at the evaporator can be made small.

With the refrigeration cycle apparatus 100, even when the sub-compressor 2 can hardly compress the refrigerant, a part of the circulating refrigerant is made to flow into the sub-compressor 2. Owing to this, with the refrigeration cycle apparatus 100, as compared with a case in which the entire amount of circulating refrigerant is made to flow, the sub-compressor 2 will not degrade the performance by becoming a passage resistance of the refrigerant. The case in which the sub-compressor 2 can hardly compress the refrigerant is, for example, a case in which the difference between the pressure of the high pressure side and the low-pressure-side pressure is small and the power recovered by the expander 7 is excessively small, such as a cooling operation with a low outdoor air temperature, or a heating operation with a low indoor temperature.

The refrigeration cycle apparatus 100 is configured such that the compression function is divided into the main compressor 1 having the driving source, and the sub-compressor 2 driven by the power of the expander 7. Hence, with the refrigeration cycle apparatus 100, the structural design and functional design can be divided. Hence, problems in view of designing and manufacturing are less than those of integrated apparatuses of the driving source, expander, and compressor.

In addition, in the refrigeration cycle apparatus 100, the refrigerant compressed by the sub-compressor 2 is injected to the compression chamber 108 of the main-compressor 1. Alternatively, for example, the compression mechanism of the main compressor 1 may be a two-stage compression mechanism and the refrigerant may be injected to a passage connecting a low-stage-side compression chamber and a latter-stage-side compression chamber. Still alternatively, the main compressor 1 may be configured to execute two-stage compression with a plurality of compressors.

In the refrigeration cycle apparatus 100, the outdoor heat exchanger 4 and the indoor heat exchanger 21 are each a heat exchanger that exchanges heat with air; however, it is not limited thereto, and may be a heat exchanger that exchanges heat with other heat mediums, such as water or brine.

In addition, in the refrigeration cycle apparatus 100, it is exemplarily described that the refrigerant passage is switched in accordance with the operation mode relating to cooling and heating, with the first four-way valve 3 and the second four-way valve 5; however, it is not limited thereto. For example, the configuration may be such that a two-way valve, a three-way valve, or a check valve switches the refrigerant passage.

Reference Signs List

1 main compressor; 2 sub-compressor; 3 first four-way valve; 4 outdoor heat exchanger; 5 second four-way valve; 6 pre-expansion valve; 7 expander; 8 accumulator; 9 intermediate-pressure bypass valve; 10 check valve; 21 indoor heat exchanger; 31 discharge piping; 32 suction piping; 33 intermediate-pressure bypass piping; 34 refrigerant passage; 35 discharge piping; 36 liquid pipe; 37 gas pipe; 43 driving shaft; 51 temperature sensor; 52 temperature sensor; 53 temperature sensor; 81 outdoor unit; 82 indoor unit; 83 controller; 84 hermetically sealed container; 100 refrigeration cycle apparatus; 101 shell; 102 electric motor; 103 shaft; 104 oscillating scroll; 105 fixed scroll; 106 inflow piping; 107 low-pressure space; 108 compression chamber; 109 compression chamber; 110 outflow port; 111 high-pressure space; 112 outflow piping; 113 injection port; 114 injection piping.

The invention claimed is:

1. A refrigeration cycle apparatus, comprising:

a main compressor configured to compress a refrigerant;

a radiator configured to radiate heat of the refrigerant compressed by the main compressor;

an expander configured to reduce a pressure of the refrigerant that has passed through the radiator;

an evaporator configured to evaporate the refrigerant that has been depressurized by the expander;

a sub-compressor having a discharge side connected to a compression chamber of the main compressor, the sub-compressor using power, which is generated in the expander when reducing the pressure of the refrigerant, to compress a portion of the refrigerant passing through the evaporator to an intermediate pressure;

an intermediate-pressure bypass configured to connect a refrigerant outflow side of the sub-compressor and a refrigerant inflow side of the main compressor to each other;

an intermediate-pressure bypass valve arranged in the intermediate-pressure bypass, the intermediate-pressure bypass valve configured to control a flow rate of the refrigerant flowing through the intermediate-pressure bypass;

a pre-expansion valve arranged between a refrigerant outflow side of the radiator and a refrigerant inflow side of the expander, the pre-expansion valve configured to reduce the pressure of the refrigerant flowing into the expander; and a controller configured to control an operation of the intermediate-pressure bypass valve and an operation of the pre-expansion valve, wherein the controller configured to regulate a pressure of a high pressure side by changing either one or both of an opening degree of the intermediate-pressure bypass valve and an opening degree of the pre-expansion valve.

2. The refrigeration cycle apparatus of claim 1, wherein the controller is configured to increase the pressure of the high pressure side by changing either one or both of the opening degree of the intermediate-pressure bypass valve and the opening degree of the pre-expansion valve when a density ratio that is obtained from an inflow refrigerant density of the expander and an inflow refrigerant density of the sub-compressor in an actual operating state is larger than a design volume ratio that is obtained from a stroke volume of the sub-compressor, a stroke volume of the expander, and a ratio of a flow rate of the refrigerant flowing to the sub-compressor, and the controller is configured to decrease the pressure of the high pressure side by changing either one or both of the opening degree of the intermediate-pressure bypass valve and the opening degree of the pre-expansion valve when the density ratio in the actual operating state is smaller than the design volume ratio.

3. The refrigeration cycle apparatus of claim 1, wherein the controller is configured to regulate the pressure of the high pressure side based on a comparative result of a target discharge temperature and a discharge temperature that is detected at a refrigerant outflow side of the main compressor.

4. The refrigeration cycle apparatus of claim 1, wherein the controller is configured to regulate the pressure of the high pressure side based on a comparative result of a target degree of superheat and a degree of superheat of the refrigerant flowing out from the evaporator.

5. The refrigeration cycle apparatus of claim 1, wherein the controller is configured to regulate the pressure of the high pressure side based on a comparative result of a target degree of supercooling and a degree of supercooling of the refrigerant flowing out from the radiator.

6. The refrigeration cycle apparatus of claim 1, wherein the controller is configured to regulate the pressure of the high pressure side by operating the pre-expansion valve when the opening degree of the intermediate-pressure bypass valve is at a minimum opening degree, and by operating the intermediate-pressure bypass valve when the opening degree of the pre-expansion valve is at a maximum opening degree.

7. The refrigeration cycle apparatus of claim 1, wherein the main compressor is a two stage compressor, and the refrigerant discharged from the sub-compressor is injected to a passage connecting a low-stage-side compression chamber and a latter-stage-side compression chamber to each other.

8. The refrigeration cycle apparatus of claim 1, wherein a refrigerant that enters a supercritical state on the high-pressure side is used as the refrigerant.

9. An operating method of a refrigeration cycle apparatus, comprising the steps of:

compressing a refrigerant with a main compressor;

radiating heat of the refrigerant compressed by the main compressor with a radiator;

reducing a pressure of the refrigerant that has passed through the radiator with an expander;

evaporating the refrigerant that has been depressurized by the expander with an evaporator;

using power, which has been generated in the expander when reducing the pressure of the refrigerant, for compressing a portion of the refrigerant passing through the evaporator to an intermediate pressure with a sub-compressor;

injecting the refrigerant compressed to the intermediate pressure by the sub-compressor to a midway position of a compression process of the main compressor;

connecting a refrigerant outflow side of the sub-compressor and a refrigerant inflow side of the main compressor to each other with an intermediate-pressure bypass;

controlling a flow rate of the refrigerant flowing through the intermediate-pressure bypass with an intermediate-pressure bypass valve;

reducing the pressure of the refrigerant that is flowing between a refrigerant outflow side of the radiator and a refrigerant inflow side of the expander and that is flowing into the expander with a pre-expansion valve; and regulating a pressure of a high pressure side by changing either one or both of an opening degree of the intermediate-pressure bypass valve and an opening degree of the pre-expansion valve on the basis of a density ratio that is obtained from an inflow refrigerant density of the expander and an inflow refrigerant density of the sub-compressor in an actual operating state and a design volume ratio and that is obtained from a stroke volume of the sub-compressor, a stroke volume of the expander, and a ratio of a flow rate of the refrigerant flowing to the sub-compressor.

10. The operating method of the refrigeration cycle apparatus of claim 9, wherein the pressure of the high pressure side is increased by changing either one or both of the opening degree of the intermediate-pressure bypass valve and the opening degree of the pre-expansion valve when the density ratio in the actual operating state is larger than the design volume ratio.

11. The operating method of the refrigeration cycle apparatus of claim 9, wherein the pressure of the high pressure side is reduced by changing either one or both of the opening degree of the intermediate-pressure bypass valve and the opening degree of the pre-expansion valve when the density ratio in the actual operating state is smaller than the design volume ratio.

* * * * *